US010199757B2

(12) United States Patent
Rech et al.

(10) Patent No.: US 10,199,757 B2
(45) Date of Patent: Feb. 5, 2019

(54) ELECTRONIC CONTROL CONNECTOR, ELECTRONIC CONTROL FOR DRIVING A HERMETIC COMPRESSOR AND HERMETIC COMPRESSOR

(71) Applicant: Whirlpool S.A., Sao Paulo (BR)

(72) Inventors: Rafael Burg Rech, Joinville (BR); Marcelo Zanelato, Joinville (BR)

(73) Assignee: Whirlpool S.A. (BR)

( * ) Notice: Subject to any disclaimer, the term of this patent is extended or adjusted under 35 U.S.C. 154(b) by 0 days.

(21) Appl. No.: 15/392,344

(22) Filed: Dec. 28, 2016

(65) Prior Publication Data

US 2017/0207560 A1 Jul. 20, 2017

(30) Foreign Application Priority Data

Jan. 15, 2016 (CN) ..... 2016 2 0154651 U
Jun. 14, 2016 (BR) ..... 102016013673

(51) Int. Cl.

| | |
|---|---|
| ***H01R 12/58*** | (2011.01) |
| ***H01R 12/71*** | (2011.01) |
| ***H01R 4/02*** | (2006.01) |
| ***H01R 13/11*** | (2006.01) |
| ***H01R 13/432*** | (2006.01) |
| ***H01R 12/70*** | (2011.01) |
| *H01R 43/02* | (2006.01) |
| *H01R 105/00* | (2006.01) |
| *H01R 12/52* | (2011.01) |

(52) U.S. Cl.

CPC ..... *H01R 12/718* (2013.01); *H01R 4/02* (2013.01); *H01R 12/7023* (2013.01); *H01R 12/716* (2013.01); *H01R 13/111* (2013.01); *H01R 13/432* (2013.01); *F25B 2400/077* (2013.01); *H01R 12/526* (2013.01); *H01R 12/585* (2013.01); *H01R 12/707* (2013.01); *H01R 43/0235* (2013.01); *H01R 43/0256* (2013.01); *H01R 2105/00* (2013.01)

(58) Field of Classification Search

CPC ..... H01R 12/585; H01R 43/0235; H01R 43/0256; H01R 12/526; H01R 12/707; H01R 2105/00

USPC ..... 439/82, 83, 106, 751, 682

See application file for complete search history.

(56) References Cited

U.S. PATENT DOCUMENTS

| | | | | |
|---|---|---|---|---|
| 5,899,754 A * | 5/1999 | Beloritsky | ..... | H01R 24/52 439/158 |
| 7,690,951 B2 * | 4/2010 | Fisher | ..... | H01R 13/74 439/682 |
| 2016/0156138 A1 * | 6/2016 | Yuba | ..... | H01R 13/53 439/682 |

* cited by examiner

*Primary Examiner* — Abdullah A Riyami
*Assistant Examiner* — Justin M Kratt
(74) *Attorney, Agent, or Firm* — Fay Sharpe LLP

(57) ABSTRACT

An electronic control connector (30) including at least an input orifice (32*a*), at least a fixing leg (33) and at least a terminal (34), the terminal (34) being inserted inside the input orifice (32*a*), the electronic control connector (30) being fixed to a printed circuit board (10) of an electronic control (50), by a fixing between the fixing leg (33) and a fixing orifice (16) disposed on the printed circuit board (10) of the electronic control (50), the fixing of the electronic control connector (30) to the printed circuit board (10) also establishing an electrical connection between the terminal (34) of the electronic control connector (30) and the tracks of the printed circuit board (10) of the electronic control (50).

26 Claims, 11 Drawing Sheets

ELECTRONIC CONTROL CONNECTOR, ELECTRONIC CONTROL FOR DRIVING A HERMETIC COMPRESSOR AND HERMETIC COMPRESSOR

CROSS REFERENCE TO RELATED APPLICATIONS

This application claims priority under 35 USC 119 to Chinese Patent Application No. 201620154651.0 filed Jan. 15, 2016 (Jan. 15, 2016) and Brazilian Patent Application No. BR102016013673-3 filed Jun. 14, 2016 (Jun. 14, 2016), and the entire disclosure of each of these applications is hereby expressly incorporated by reference into the present application.

FIELD OF THE INVENTION

The present invention relates to an electronic control connector fixed to the printed circuit board of an electronic control, the connector simultaneously being fixed to said board and establishing an electrical connection with the tracks of the printed circuit board. The connector being electrically connected to the connector of the hermetic compressor, such that the electronic control electrically drives the hermetic compressor.

BACKGROUND

With the objective of achieving high energy and cooling efficiency, today household and commercial cooling systems use Variable Capacity Compressors—VCC. The characteristics of these compressors are adjustments in the cooling capacity by varying the pumping speed of cooling gas, that is, their mass flow, in accordance with the system requirement and cooling demand.

The variation in the mass flow is from a minimum value to a maximum value, said range of values being proportional to the rotation of the electric motor that drives the hermetic variable capacity compressor. The variation of the rotation is obtained in these compressors by means of an electronic control, called frequency inverter, which adjusts the voltage and the frequency applied to the electric motor.

In general terms, the frequency inverter is provided with various electronic circuits having different functions, such as, for example, a power circuit with input stage for electromagnetic interference filtering and a rectifier bridge stage for converting an alternating current coming from an external power source into a continuous voltage, a control circuit (microcontroller or Digital Signal Processor—DSP), an auxiliary power source for generating internal voltage for other circuits or components of the inverter, a circuit formed by power semiconductors for driving the electric motor employed in the compressor, among others.

It is noted that the electrical connection and fixing of the frequency inverter to the hermetic compressor requires carrying out various steps on the production line. This results in a loss of efficiency and high production and assembly cost of the frequency inverter.

Another problem noted concerns the use of cables for electrical connection between the frequency inverter and the connector, which is generally provided with three pins, of the hermetic compressor. The use of a cable requires the fixing thereof to the printed circuit board of the frequency inverter, which results in increased general costs of production and time, due to the need to solder the cable to the board of the inverter or to use an additional connector on the board.

Additionally, it is noted in the state of the art that the frequency inverter is disposed in a closed plastic box, which is encased mechanically to the support surface ("fence") of the hermetic compressor, being fastened by means of screws, to meet the standard requirements.

The problems above are noted when carrying out the steps of fixing of the frequency inverter to the support surface ("fence") of the hermetic compressor, which will be detailed ahead.

The first step is carried out by fixing the components and circuits which make up the frequency inverter on the printed circuit board.

After this step, the connector for feeding the hermetic compressor motor is mounted on the printed circuit board. The grounding connector of the electromagnetic interference filtering circuit (ground connection point) is mounted on the printed circuit board.

The ground branch terminal is pressed in the plastic body of the outer casing.

The printed circuit board is then mounted on the plastic base of the plastic body of the outer casing.

A connection cable of the motor is connected to the connector for feeding the hermetic compressor motor, previously mounted on the printed circuit board. A grounding cable of the electromagnetic interference filtering circuit is connected to the connector positioned on the printed circuit board.

The cable coming from the grounding connector of the electromagnetic interference filtering circuit is connected to the grounding terminal fixed to the plastic body.

The plastic body of the outer casing is mounted on the plastic base, such that the cables previously mounted pass through orifices existing in said body.

The plastic lid is then closed, making interface with the base and the plastic bodies, the lid is screwed to the assembly of base and body, the connector of the cable of the motor is coupled to the connector of the hermetic compressor, a branch of the grounding cable of the electromagnetic interference filtering circuit is coupled to the ground terminal of the compressor, the plastic assembly is encased in the compressor through the orifice existing in the plastic body and the assembly is fixed to the hermetic compressor by means of screws.

SUMMARY OF THE INVENTION

Therefore, it is not noted in the state of the art an electronic control connector (frequency inverter) encased in the printed circuit board of an electronic control, the connector being capable of simultaneously being fixed mechanically to said board and establishing an electrical connection with the tracks of the printed circuit board. The connector being electrically connected to the connector of the hermetic compressor, such that the electronic control electrically drives the hermetic compressor. The connector enabling the elimination of cables for connection to the hermetic compressor and fewer steps for connecting the frequency inverter to the support surface of the hermetic compressor.

The first objective of the present invention is to provide connection means of an electronic control, which require a fewer number of steps necessary for assembling and subsequent connection to the hermetic compressor.

The second objective of the present invention is to provide connection means of an electronic control, which eliminate the need to use cables for connection to the hermetic compressor.

A third objective of the present invention is to provide connection means of an electronic control, which have lower manufacturing costs.

A fourth objective of the present invention is to provide connection means of an electronic control having lower costs in the operation of assembling the compressor.

A fifth objective of the present invention is to provide a fast connection and disconnection of the electronic control connector.

The objectives of the present invention are achieved by means of an electronic control connector comprising at least an input orifice, at least a fixing leg and at least a terminal, the at least a terminal being inserted inside the at least an input orifice, the electronic control connector being fixed to a printed circuit board of an electronic control, by means of a mechanical fixing between the at least a fixing leg and at least a fixing orifice disposed on the printed circuit board of the electronic control, the fixing of the electronic control connector to the printed circuit board further establishing an electrical connection between the at least a terminal of the electronic control connector and the tracks of the printed circuit board of the electronic control.

The objectives of the present invention are further achieved by means of an electronic control for driving a hermetic variable capacity compressor comprising a printed circuit board and an electronic control connector, the printed circuit board comprising tracks and at least a fixing orifice, the electronic control connector comprising at least an input orifice, at least a fixing leg and at least a terminal, the at least a terminal being inserted inside the at least an input orifice, at least a fixing leg being fixed to the at least a fixing orifice, the fixing establishing the fixing of the electronic control connector to the printed circuit board and the electrical connection between the terminal of the electronic control connector and the tracks of the printed circuit board of the electronic control.

Lastly, the objectives of the present invention are achieved by means of a hermetic variable capacity compressor driven electrically by an electronic control comprising a connector of the hermetic compressor provided with at least three pins, the at least three pins of the connector of the hermetic compressor being electrically connected to at least three terminals of an electronic control connector, the electronic control connector being fixed to the electronic control and the at least a terminal being electrically connected to tracks of the electronic control.

BRIEF DESCRIPTION OF THE DRAWINGS

The present invention will now be described in greater detail based on a sample execution represented in the drawings. The drawings show.

DETAILED DESCRIPTION

Figure 2:
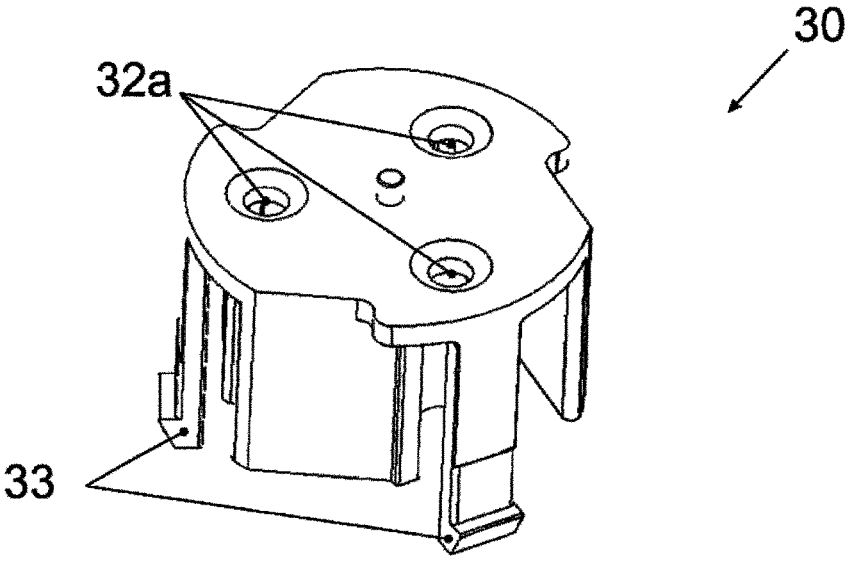
FIG. 2 is a top view of the electronic control connector, according to the teachings of the present invention.
Figure 3:
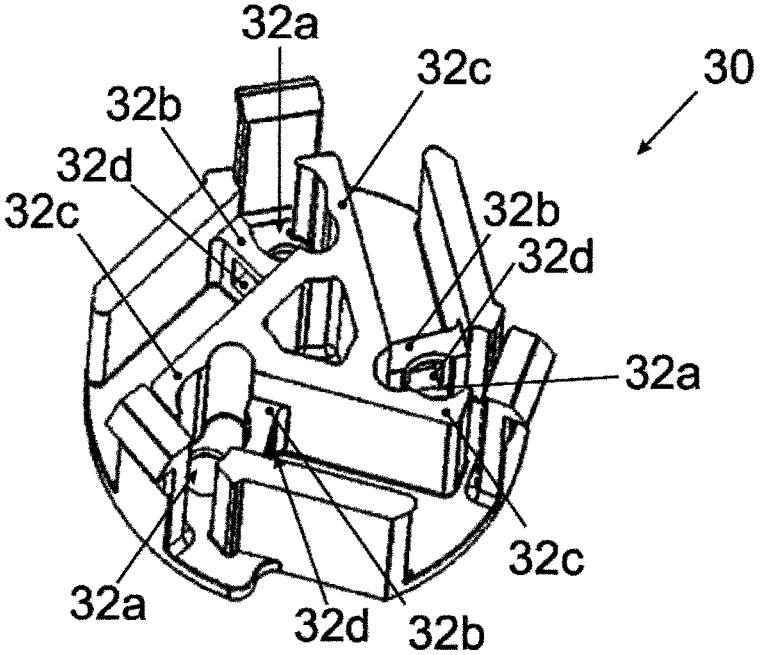
FIG. 3 is a bottom view of the electronic control connector, according to the teachings of the present invention.
Figure 4:
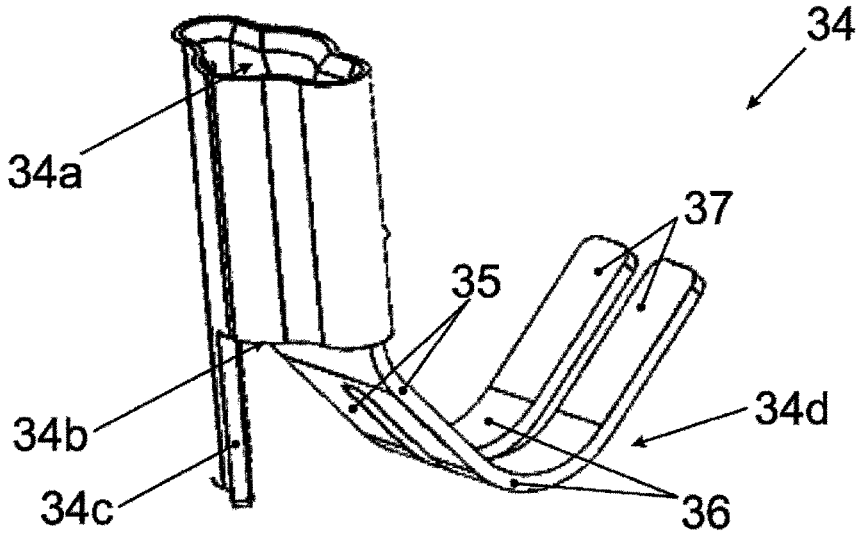
FIGS. 4 to 9 are illustrations of the terminals which are inserted inside the input orifices of the electronic control connector, according to the teachings of the present invention.
Figure 5:
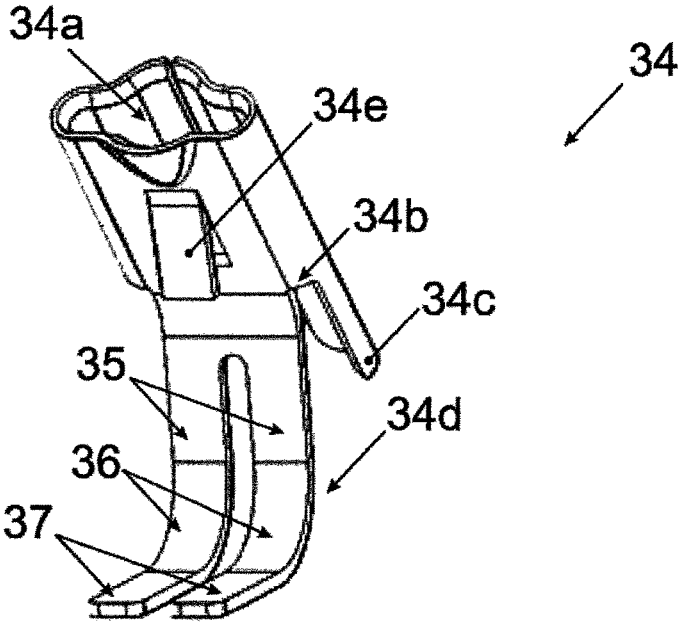
Figure 6:
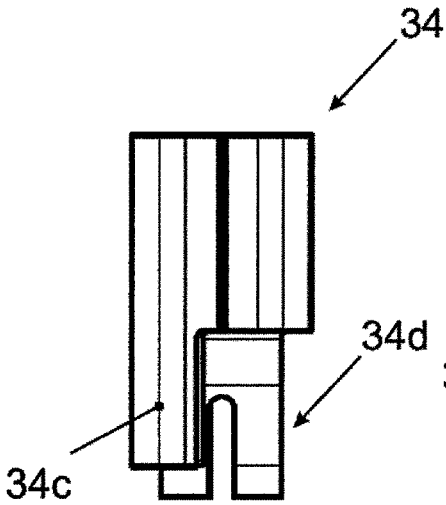
Figure 7:
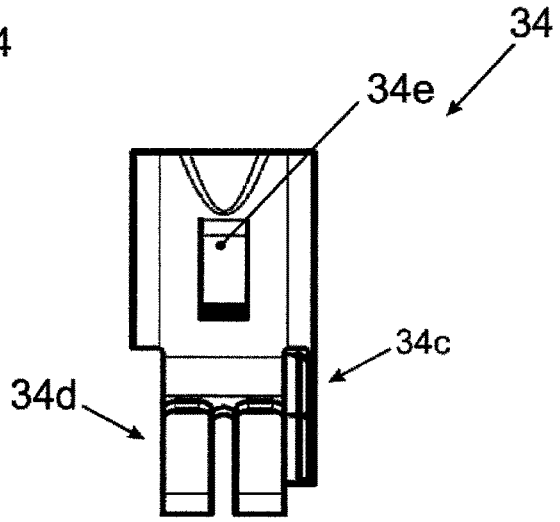
Figure 8:
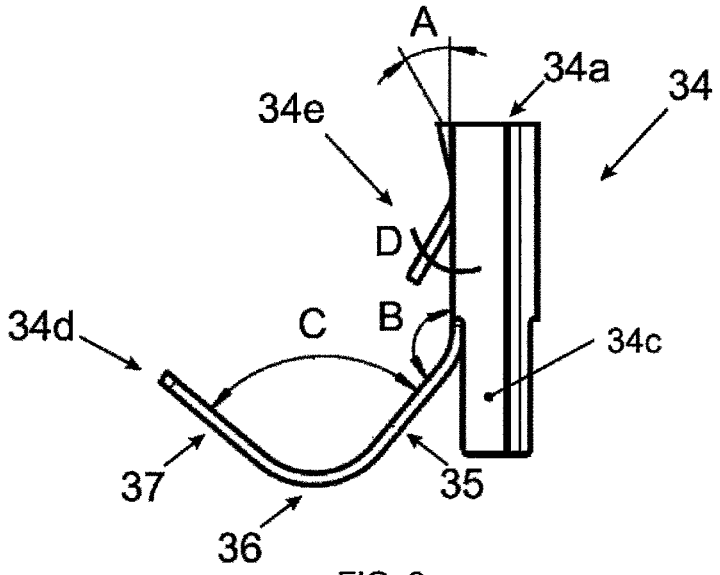
Figure 9:
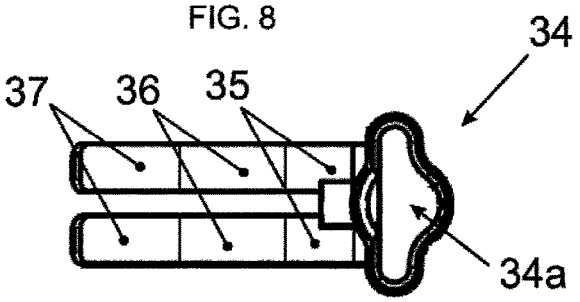

FIGS. 2 to 3 illustrate the electronic control connector 30 and FIGS. 4 to 9 illustrate the terminals 34 which are inserted inside the input orifices 32*a* of the electronic control connector 30, objects of the present invention.

The electronic control connector 30 being used for electrically connecting an electronic control 50 to a hermetic compressor 200.

In a preferred embodiment, the electronic control 50 can be a frequency inverter provided with various electronic circuits having different functions, such as, for example, a power circuit with input stage for electromagnetic interference filtering and a rectifier bridge stage for converting an alternating current coming from an external power source into a continuous voltage, a control circuit (microcontroller or Digital Signal Processor—DSP), an auxiliary power source for generating all internal voltages for other circuits or components of the inverter, a circuit formed by power semiconductors for driving the electric motor employed in the compressor, among others.

Obviously, this is just a preferred embodiment, such that alternatively the electronic control 50 can be another type of component or a combination of other components, capable of controlling the hermetic compressor 200, such as the start-up system for compressor with single-phase motor, a thermostat system for controlling the temperature of a cooler, a motor control system with Taps for arrangement in 110V or 220V, among others.

The electronic control 50 is used for controlling the voltage and the frequency applied to the hermetic compressor 200, specifically for variable capacity compressors 200, thus varying the pumping speed of the cooling gas, that is, its mass flow, in accordance with the system requirement and its demand for cooling.

In a preferred embodiment, the hermetic compressor 200 is driven by three-phase brushless DC electric motors. However, it is important to note that the present invention is not limited to just this type of electric motor, such that other single-phase, two-phase or three-phase motors can be used, depending on the desired application.

The electronic control 50, object of the present invention, can be disposed on a first face 11 of a printed circuit board 10, on a second face 12 of the printed circuit board 10 or on both faces 11, 12. In a preferred embodiment, the first face 11 is the one that faces an outer casing 150 and the second face 12 is the one facing a support surface 201 of the hermetic compressor, as detailed ahead. The disposition on a certain face neither establishes a limitative character, nor alters the innovative characteristics of the present invention.

In general terms, the printed circuit board 10 is a board known in the state of the art, and can be made of phenolic, fiberglass, polyester fiber, diverse specific polymer-based films, among others. The first face 11 and a second face 12 of the printed circuit board 10 being provided with fine copper foils, which establish conduction tracks, where the components of the electronic control 50 are soldered and electrically interconnected to each other.

Figure 1:
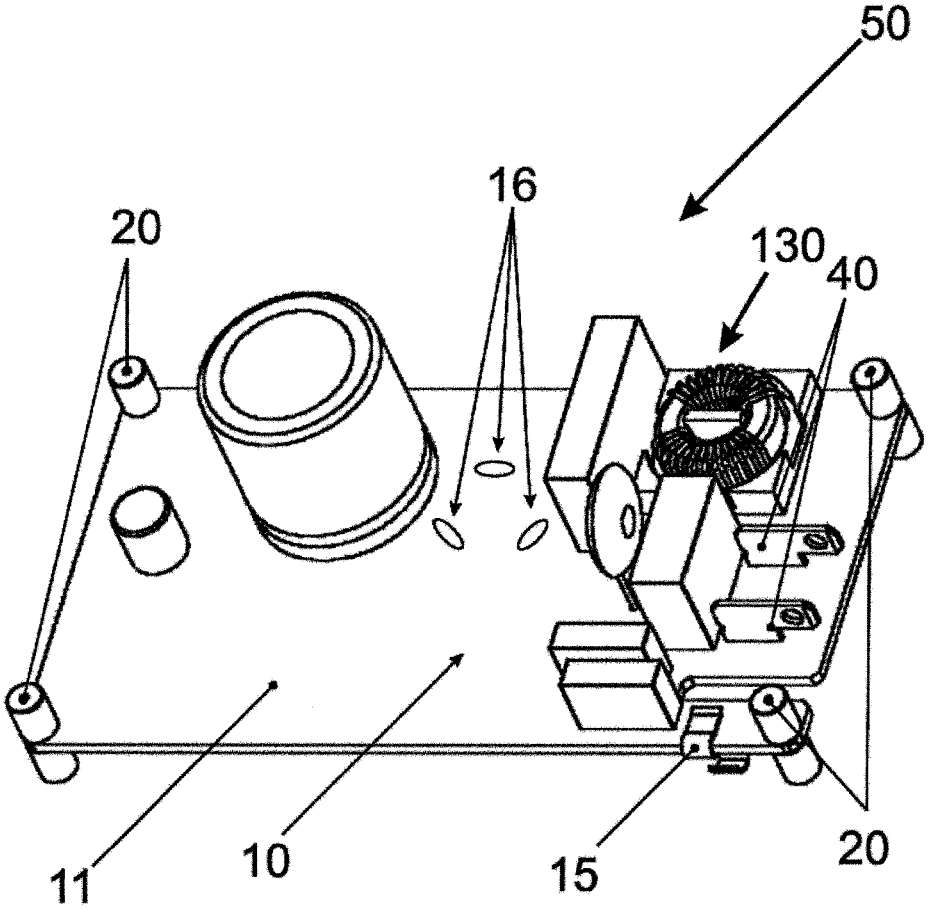
FIG. 1 is an illustration of the electronic control seen from the first face of the printed circuit board, showing at least a fixing orifice for encasing the connector, according to the teachings of the present invention.

Further, still in reference to FIG. 1, it can be noted that it illustrates that the printed circuit board 10 is provided with external feed terminals 40 of the printed circuit board 10, the terminals 40 being electrically connected to the electronic control 50 and to an external voltage feed source (not shown).

It is also noted that the printed circuit board 10 is provided with at least a fixing orifice 16, which receives the electronic control connector 30, as described ahead.

Regarding FIGS. 2 and 3, it can be noted that they illustrate the electronic control connector 30, object of the present invention. In a preferred embodiment, the electronic control connector 30 is made of insulating plastic materials resistant to the high electric currents to be applied to the hermetic compressor 200.

It is further noted from FIGS. 2 and 3 that the electronic control connector 30 comprises at least an input orifice 32*a*, at least a first support wall 32*b*, at least a second support wall 32*c* and at least a fixing leg 33.

It is noted that the at least a first support wall 32*b* and the at least a second support wall 32*c* are adjacent to the input orifice 32*a*. More specifically, the at least a first and a second support walls 32*b*, 32*c* are opposite to each other in relation to the at least an input orifice 32*a*, such that they substantially form a cavity or a passage duct from the outside to the inside of the connector 30.

The at least a first support wall 32*b* being further provided with a recess 32*d* that surpasses the sides of the at least a first support wall 32*b* and being positioned in an intermediary region between the upper and lower ends of said first support wall 32*b*.

Figure 10:
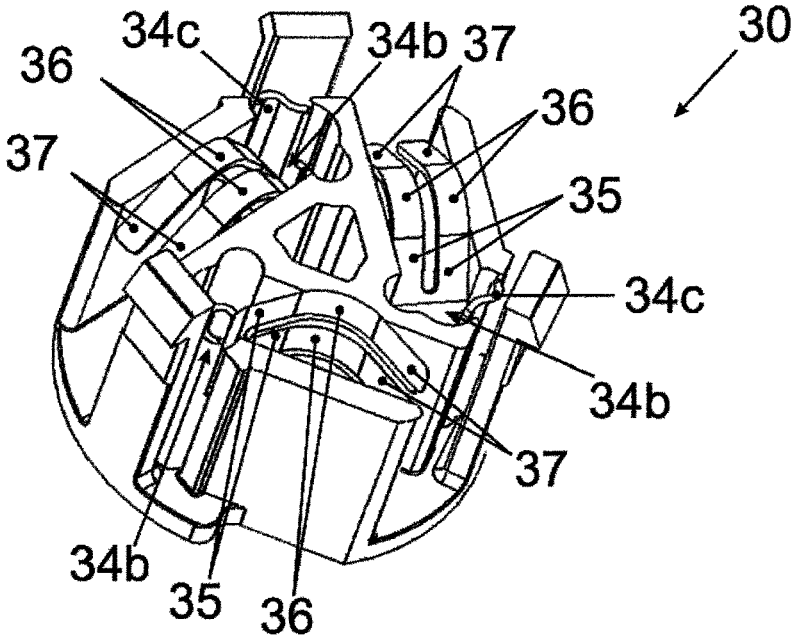
FIG. 10 is a bottom view of the electronic control connector, showing the terminals inserted into the orifices of the connector, according to the teachings of the present invention.
Figure 11:
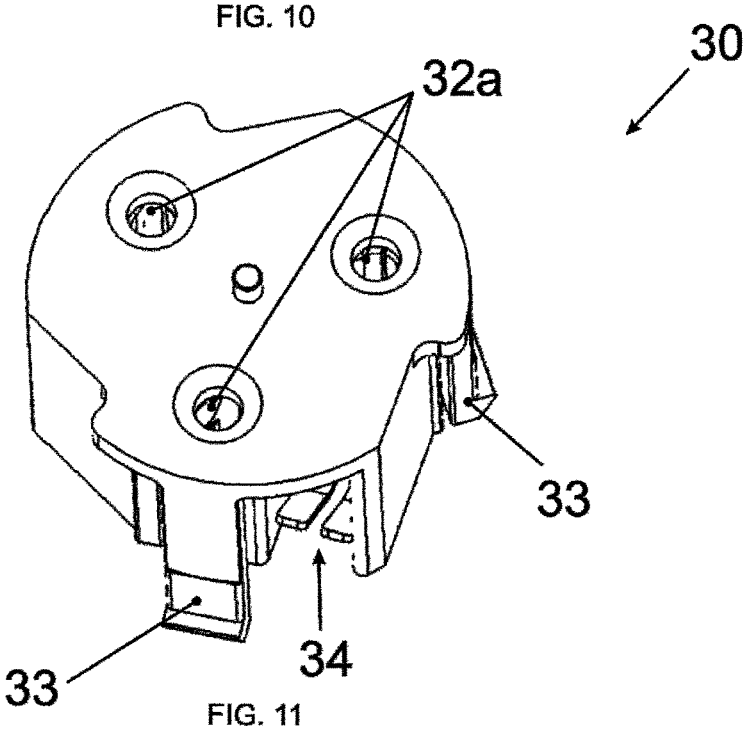
FIG. 11 is a top view of the electronic control connector with the terminals inserted into its orifices, according to the teachings of the present invention.

Said electronic control connector 30 receiving therein at least an input orifice 32*a* at least a terminal 34, as illustrated in FIGS. 10 and 11 and as described in greater detail ahead.

In relation to the at least a terminal 34, illustrated in FIGS. 4 to 9, it is noted that it is inside the at least an input orifice 32*a*, as described ahead and as illustrated in FIGS. 10 and 11. In a preferred embodiment, the at least a terminal 34 is made of phosphor bronze, capable of conducting electricity and having considerable resistance to corrosion and is approximately 0.40 millimeter (mm) thick.

Other materials such as copper alloys, tin alloys, stainless steels, among others, could also be used. It must be emphasized that the material of the at least a terminal 34 should conduct electricity and should be resistant to corrosion and to the high electric currents to be applied to the hermetic compressor 200.

In further reference to FIGS. 4 to 9, it is noted that the at least a terminal 34 comprises an upper portion 34*a*, a lower portion 34*b*, a side support projection 34*c*, an electric contact portion 34*d* and a fixing projection 34*e*.

The upper portion 34*a* is substantially X-shaped, formed by two elliptical portions, the first portion on the horizontal axis having a wider cross-section in length (6.00 millimeters (mm)) and shorter in width compared to the second portion on the vertical axis (2.00 millimeters (mm)). The second portion on the vertical axis presenting one of the ends with greater curvature than the other and having an inclination A of approximately 30° and 2.00 millimeters (mm) in length. The intersection of the portions defines a central orifice. It is noted that it extends from the upper portion 34*a* to the lower portion 34*b* of the terminal 34. Preferably, the central orifice is approximately 2.60 millimeters (mm) in diameter.

It must be emphasized that said shape and measurements refer solely to a preferred embodiment, such that any other shapes or measurements can be used, provided that the central orifice has a cooperating shape with the shape of the input orifice 32*a* of the electronic control connector 30.

FIGS. 4 to 9 also illustrate a side support projection 34*c*, which extends sidewardly along one of the ends of the horizontal portion of the upper portion 34*a* of the terminal 34. Said side support projection 34*c* extending linearly from the upper portion 34*a* to beyond the lower portion 34*b*, that is, the side support projection 34*c* has a greater length than the one comprised between the upper portion 34*a* and the lower portion 34*b*.

Preferably, the length between the upper portion 34*a* and the lower portion 34*b* is 6.50 millimeters (mm) and that of the side support projection 34*c* is 11.00 millimeters (mm). Moreover, the side support projection 34*c* in its greater length than the one comprised between the upper portion 34*a* and the lower portion 34*b* is 0.60 millimeter (mm) distant from the vertical axis of the central orifice.

It must be emphasized that although the terminal 34 presents a single side support projection 34*c*, said embodiment does not represent a limitative character. In other words, the terminal 34 could comprise a plurality of side support projections 34*c* or even a projection 34*c* extending along part of or all the outer surface of the horizontal and vertical portions of the upper and lower portions 34*a*, 34*b*.

Another element illustrated in FIGS. 4 to 9 is the electric contact portion 34*d*. It can be noted that it projects outwardly from the end and in an opposite direction to a vertical axis of the lower portion 34*b*.

In a preferred embodiment, the electric contact portion 34*d* comprises a curvilinear shape, a V-shape or a U-shape. It is noted that the shapes cited are not compulsory, such that any other shapes could be used, provided that their functionality is substantially similar to that of the preferred shapes.

Further preferably, the electric contact portion 34*d* is formed by a first straight portion 35, a curvilinear portion 36 and a second straight portion 37. The first straight portion 35 projecting from the end and in an opposite direction to the lower portion 34*b*, the curvilinear portion 36 starting from the end of the first straight portion 35 and a second straight portion 37 starting from the end of the curvilinear portion 36. The function of the second straight portion 37 is to guide the terminal 34 inside the connector 30, as seen in FIG. 10 and which will be described in greater detail ahead.

Preferably, the length of the first straight portion 35 is 1.40 millimeter (mm) and begins after a patch with curvature B of 140 degrees and a radius of 2.00 millimeters (mm), the curvilinear portion 36 has a curvature C of 90 degrees and radius of 2.50 millimeters (mm) and the second straight portion 37 has a length of 4.30 millimeters (mm). The thickness of the first straight portion 35, of the curvilinear portion 36 and of the second straight portion 37 being 0.40 millimeter (mm). The vertex of the curvilinear portion 36 being 1.00 millimeter (mm) higher and distant from the end of the side support projection 34*c*.

The length between the end of the second straight portion 37 to the end of the terminal 34 opposite the second straight portion 37 being approximately 12.56 millimeters (mm) and the length between the vertex of the curvilinear portion 36 to the end of the terminal 34 opposite the second straight portion 37 being approximately 7.40 millimeters (mm).

Also in a preferred embodiment, the terminal 34 comprises two electric contact portions 34*d* separated between a distance of 0.80 millimeter (mm) and having a maximum length between sides of approximately 4.00 millimeters (mm).

It is also noted that FIGS. 4 to 9 show the fixing projection 34*e* in the terminal 34. Preferably, it is disposed between the upper portion 34*a* and the lower portion 34*b* of the terminal 34. More specifically, the fixing projection 34*e* projects outwardly and in the opposite direction to a vertical axis of the central orifice of the terminal 34, the fixing projection 34*e* being disposed and extending from a point near the upper portion 34*a* to a point near the lower portion 34*b*. The fixing projection 34*e* on the terminal 34 has a height of approximately 2.90 millimeters (mm) in relation to the vertical axis of the central orifice of the terminal 34. The fixing projection 34*e* having a width of 1.50 millimeter (mm) and an angle of approximately 30 degrees in relation to the vertical axis of the central orifice of the terminal 34.

It is noted that the at least a fixing leg 33 is a projection positioned on an outer circumference of an upper surface of the electronic control 30, the at least a fixing leg 33 having an outward-sticking tooth in an opposite direction to a vertical axis of an upper surface of the electronic control 30, and may be L-shaped. The at least a fixing leg 33 being disposed perpendicularly to the at least a first support wall 32*b* and to the at least a second support wall 32*c*.

It must be emphasized that the shape of the fixing leg 33 should be cooperative with the shape of the fixing orifice 16, such that the fixing leg 33 can be inserted, encased and locked on the printed circuit board 10.

The at least a fixing leg 33 is also made from plastic materials and presents a certain elasticity, so it elastically deforms towards the input orifice 32*a* by applying pressure. Said characteristic enables the electronic control connector 30 to be inserted and encased in the fixing orifice 16 of the printed circuit board 10.

After having been inserted into the fixing orifice 16, the pressure on the fixing leg 33 should be interrupted, so that the fixing leg 33 elastically deforms to its initial position. This characteristic enables the electronic control connector 30 to be locked in the fixing orifice 16 of the printed circuit board 10.

It must be emphasized that the above form of fixing is merely a preferred embodiment, and that any other form of fixing can be used, such as, for example, soldering the electronic control connector 30 on the printed circuit board 10, by soldering the at least a fixing leg 33 to the at least a fixing orifice 16. It must be emphasized that the form of fixing must guarantee permanent or provisional locking of the electronic control connector 30 in the fixing orifice 16 of the printed circuit board 10.

As previously highlighted, the at least a terminal 34 is inserted inside the at least an input orifice 32*a* of the electronic control connector 30.

More specifically, and as noted from FIGS. 10 and 11, the upper portion 34*a* and the lower portion 34*b* of the terminal 34 are inserted into the cavity formed between the first and the second support walls 32*b*, 32*c* and the input orifice 32*a* of the electronic control connector 30.

When inserting the at least a terminal 34 inside the at least an input orifice 32*a:*

- the fixing projection 34*e* projects inwardly of the recess 32*d* of the electronic control connector 30. The fixing projection 34*e* being configured to lock the terminal 34 to the electronic control connector 30;
- the side support projection 34*c* remains disposed adjacent to the fixing leg 33, more specifically adjacently to an inner surface of the cavity formed between the first and the second support walls 32*b*, 32*c* and the input orifice 32*a* of the electronic control connector 30; and
- the terminal 34 is guided by the walls 32*b* and 32*c* for insertion into the connector 30.

After said insertion, the pressure created by the interference between the at least a fixing leg 33 and the wall of the at least an orifice 16 of the printed circuit board 10, that is, when pressing the connector 30 on the printed circuit board 10, deformation of the fixing leg 33 occurs. The electronic control connector 30 being encased in the at least a fixing orifice 16 on any of the faces 11, 12 of the printed circuit board 10.

After having been inserted into the fixing orifice 16, the pressure on the at least a fixing leg 33 should be interrupted, so that the fixing leg 33 elastically deforms to its initial position. This characteristic enables the electronic control connector 30 to be locked on the fixing orifice 16 of the printed circuit board 10.

It is noted that besides the electronic control connector 30 being mechanically fixed to the printed circuit board 10, an electrical connection is also established between the at least a terminal 34 of the electronic control connector 30 and the tracks of the printed circuit board 10 of the electronic control 50.

Figure 16:
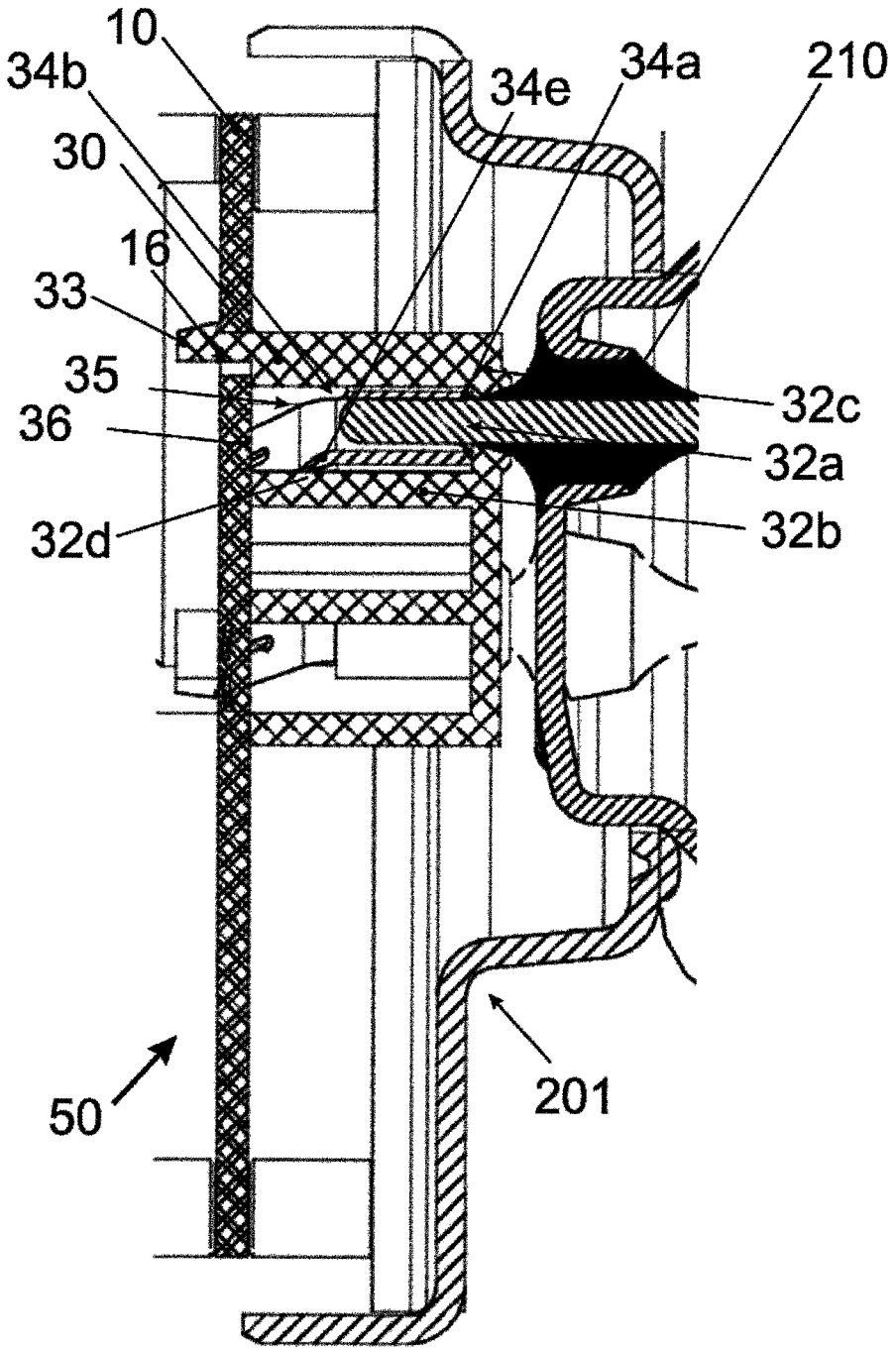
FIG. 16 is a sectional view of the connection of the electronic control of the hermetic compressor, showing the mechanical fixing of the electronic control connector to the printed circuit board and the electrical connection between a terminal of the electronic control connector and a pin of the connector of the hermetic compressor. The picture also illustrates the terminal of the electronic control connector in contact with the printed circuit board.

As well illustrated in FIG. 16, after having been fixed to the printed circuit board 10, some of the ends of the side support projection 34*c* of the terminal 34 establish a contact with the printed circuit board 10. The side support projection 34*c* prevents the terminal 34 from moving inside the electronic control connector 30, thus preventing excessive deformation of the electric contact region 34*d*, when the electronic control connector 30 with the terminals 34 is connected to the connector of the hermetic compressor 210.

Similarly, the electric contact portion 34*d* presents a degree of freedom of movement capable of preventing the angular movement of the electric contact portion 34*d*, guaranteeing the electrical connection between the electric contact portion 34*d* and the tracks of the printed circuit board 10 of the electronic control 50.

The side support projection 34*c* acting as stopper, so that when connecting or removing the electronic control connector 30 of the connector of the hermetic compressor 210, the terminal 34 does not move, thus exercising an excessive force in the contact region 34*d*. This excessive force may plastically deform the contact region 34*d* meaning the electric contact between the portion 34*d* and the tracks of the printed circuit board 10 is lost.

After the mechanical and electrical fixing of the electronic control connector 30 to the printed circuit board 10, the electrical connection between said connector and the hermetic compressor 200 may be carried out.

In a preferred embodiment, the connector of the hermetic compressor 210 comprises at least three pins and the electronic control connector 30 comprises three terminals 34. It must be emphasized that the number of terminals 34 of the electronic control 30 and the number of pins of the connector of the hermetic compressor 210 are proportional and vary according to the hermetic compressor 200 used (single-phase, two-phase, three-phase).

When electrically connecting the hermetic compressor 200, the pins of the connector of the hermetic compressor 210 are inserted inside the cavity formed between the first and the second support walls 32*b*, 32*c* and the input orifice 32*a* of the electronic control connector 30, such that the terminal 34 of the electronic control connector 30 is electrically connected to the respective pin of the connector of the hermetic compressor 210.

Figure 12:
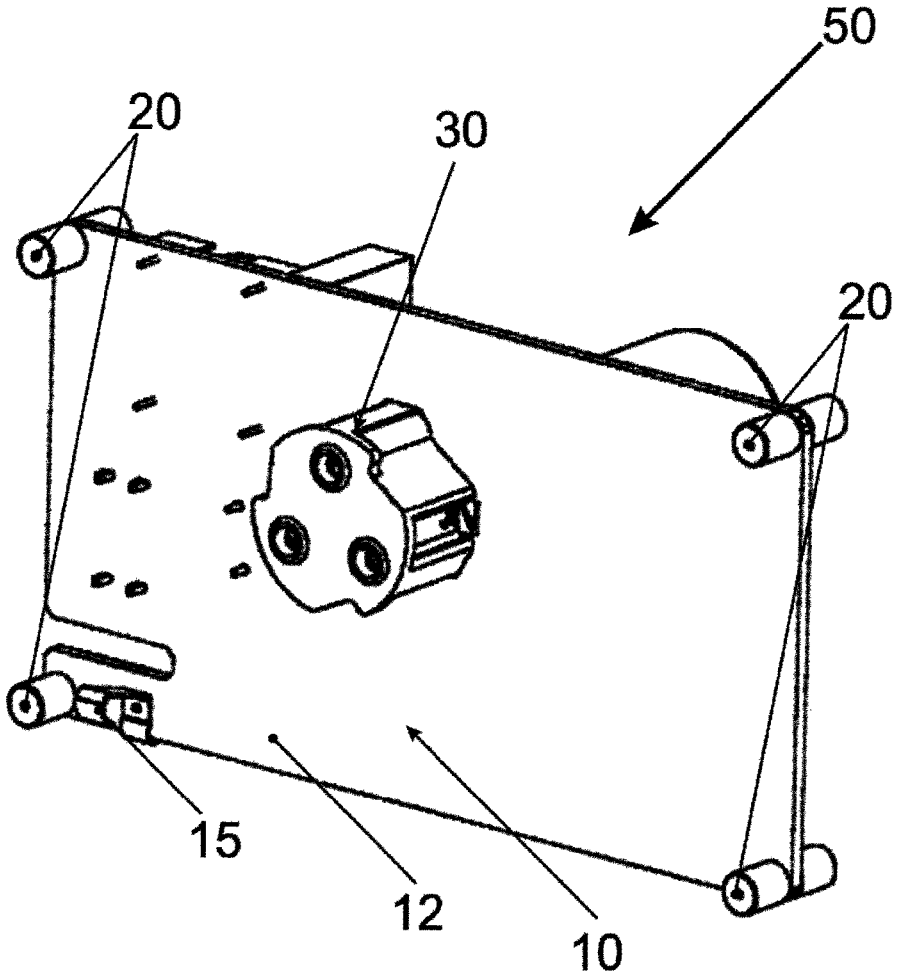
FIG. 12 is an illustration of the electronic control connector encased in the second face of the printed circuit board, according to the teachings of the present invention.

It is noted from FIGS. 1 and 12 that at least a seating means 20 is fixed to the first face 11 and to the second face 12 of the printed circuit board 10. In a preferred embodiment, the at least a means 20 is disposed at the ends/vertices of the printed circuit board 10, symmetrically between both faces 11, 12. Symmetry occurs by means of the connection of the at least a seating means 20 between the faces 11, 12 by means of an orifice that surpasses the ends/vertices where it is disposed. This is merely a preferred embodiment, such that the at least a means 20 can be disposed on any region of the faces 11, 12 and can be maintained disconnected between them.

In a preferred embodiment, the at least a seating means 20 is made of elastically deformable materials, such as rubbers, polymers, springs or any other materials capable of elastically deforming by a mechanical effort (for example, compression).

It is also noted from FIGS. 1 and 12 that the printed circuit board 10 is provided with a ground connection point 15. Preferably, this is a metal contact in the shape of a hook, for subsequent electrical connection to a support surface 201 of the hermetic compressor 200, as described ahead. The ground connection point 15 being electrically connected to the board 10 and being configured to earth an electromagnetic interference circuit 130 disposed on the printed circuit board 10.

Obviously, the hook shape is merely a preferred embodiment, and any other type of connection can be used, provided that it is capable of establishing contact with the support surface 201.

Figure 13:
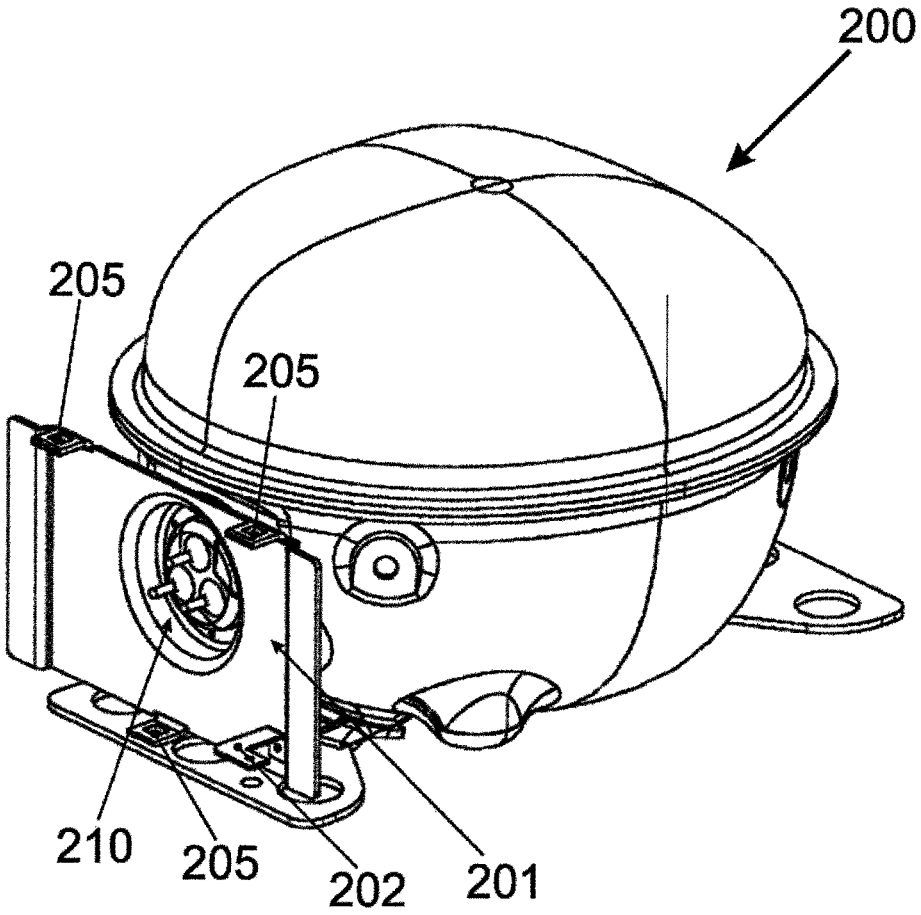
FIG. 13 is an illustration of the hermetic compressor, showing its connector and its support surface, according to the teachings of the present invention.

Regarding the hermetic compressor 200, it can be noted from FIG. 13 that it is provided with a support surface 201 and of a connector of the hermetic compressor 210. In a preferred embodiment, the support surface 201 has a shape cooperative with the shape of the printed circuit board 10, since latter will be fixed thereon. The support surface 201 presents in its central region an orifice for the passage of the connector of the hermetic compressor 210.

Preferably, the connector of the hermetic compressor 210 is provided with at least three connections (male connectors), which are electrically connected to the female-type connections of the electronic control connector 30 of the printed circuit board 10. The number of connections depends on the type of electric motor used (single-phase, two-phase or three-phase). As described ahead, said electrical connection enables the electric motor of the hermetic compressor 200 to receive power signals of the electronic control 50.

Additionally, FIG. 13 shows that the support surface 201 of the hermetic compressor 200 is provided with a projection 202 and of at least an encasement 205.

The projection 202 of the support surface 201 being configured for subsequent electrical connection with the ground connection point 15 of the printed circuit board 10, as described in greater detail ahead. The at least an encasement 205 being configured for receiving the outer casing 150 of the connection and fixing means. The hermetic compressor 200, the projection 202, the support surface 201 and the at least an encasement 205 being made of metal materials and all being grounded, to prevent damages from any electrical discharges and/or short circuits.

As can be noted from FIG. 17, the outer casing 150 of the connection means and fixing is provided with an internal cavity 151 and with an opening 152, preferably lateral, for access to the external power terminals 40 of the printed circuit board 10, as subsequently described. The outer casing 150 can be made of any material, especially plastic materials.

Figure 14:
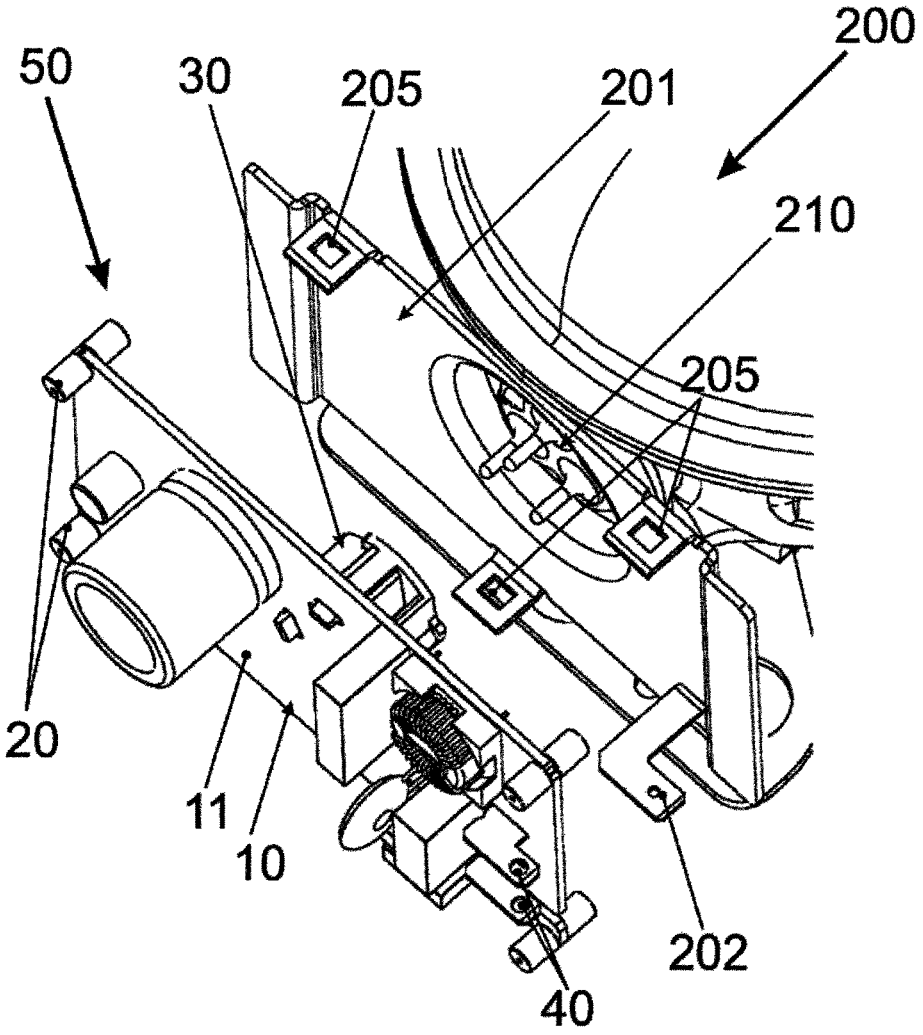
FIG. 14 is an illustration of the electronic control to be connected to the hermetic compressor, by means of the electrical connection between its respective connectors, according to the teachings of the present invention.
Figure 15:
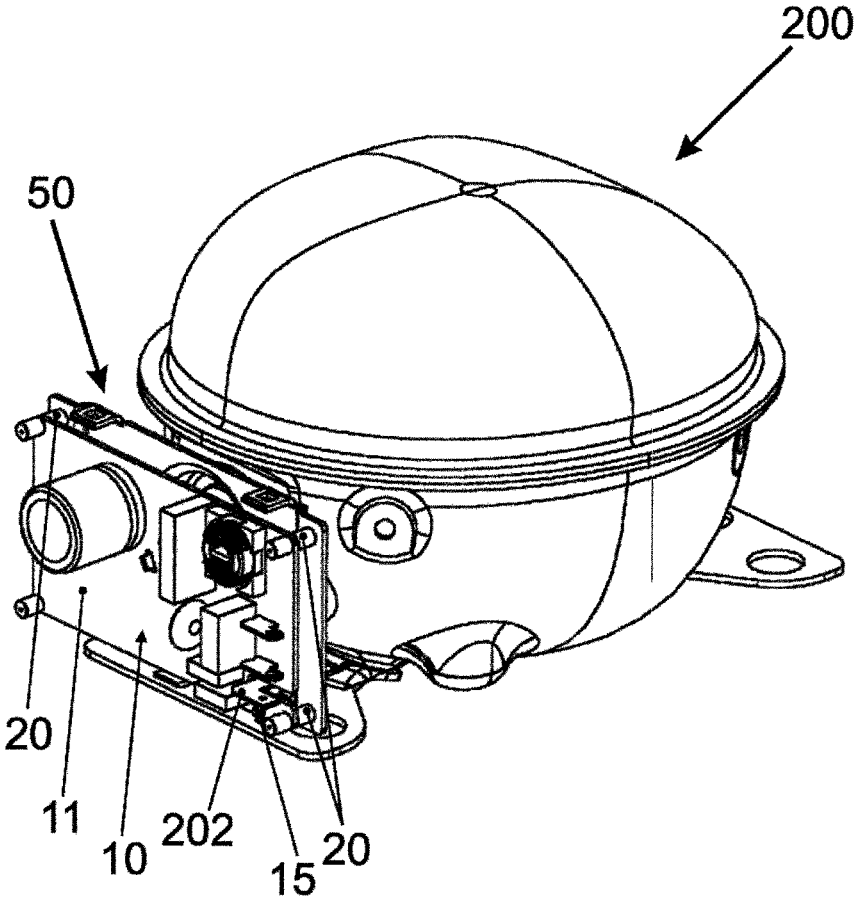
FIG. 15 is an illustration of the electronic control connected to the hermetic compressor, according to the teachings of the present invention.

It can be seen from FIGS. 13 to 15, the partial assembly of the connection and fixing means, object of the present invention, in the hermetic compressor 200, especially the electrical connection and fixing of the printed circuit board 10 with the electronic control 50 to the support surface 201 of the hermetic compressor 200.

The printed circuit board 10 with the electronic control 50 is initially placed parallel to the support surface 201 of the hermetic compressor 200 and being moved linearly until the electronic control connector 30 and the connector of the hermetic compressor 210 are aligned with each other.

It is noted that the printed circuit board 10 simultaneously:

- establishes a contact with the hermetic compressor 200, by means of a contact between the at least a seating means 20 disposed on the second face 12 and the support surface 201 of the hermetic compressor 200;
- establishes an electrical connection with the hermetic compressor 200, by means of an electrical connection between the electronic control connector 30 and the connector of the hermetic compressor 210; and
- establishes an electrical connection between the ground connection point 15 of the printed circuit board 10 and a projection 202 of the support surface 201 of the hermetic compressor 200.

It can be noted that after having established the electrical connection and the mechanical contacts between the above elements, the printed circuit board 10 is connected and fixed, respectively, to the connector of the hermetic compressor 210 and to the support surface 201, in a substantially stable manner and without the need to use fixing means (such as screws). Moreover, it is noted that the electromagnetic interference filtering circuit 130 of the board 10 is grounded, since an electrical ground connection was established with the hermetic compressor 200.

Figure 17:
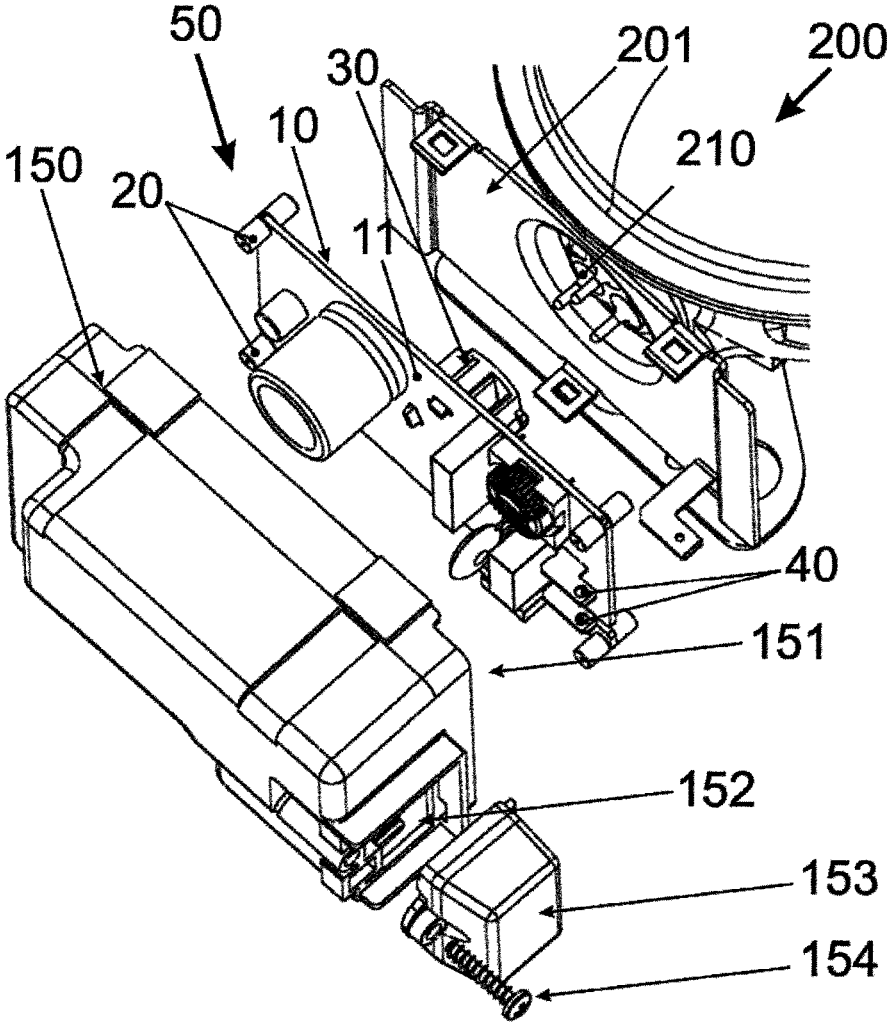
FIG. 17 is an illustration of the electronic control to be connected to the connector of the hermetic compressor and to the support surface of the hermetic compressor, according to the teachings of the present invention.

FIG. 17 illustrates the complete assembly of the connection and fixing means, object of the present invention, with the hermetic compressor 200, especially the electrical connection and the fixing of the printed circuit board 10 with the electronic control 50 to the support surface 201 of the hermetic compressor, the encapsulation of the printed circuit board 10 with the electronic control 50 by the outer casing 150 and the fixing of the outer casing 150 to the support surface 201 of the hermetic compressor 200.

After said electrical connection and mechanical contacts previously described, the outer casing 150 receives and encapsulates, in its internal cavity 151, the printed circuit board 10 with the electronic control 50, with the at least a seating means 20 and with the electronic control connector 30.

After said encapsulation, the outer casing 150 establishes a contact with the at least a seating means 20 of the first face 11, the outer casing 150 being fixed to the support surface 201 of the hermetic compressor 200 by means of encasements 205 of the support surface 201. The external power terminals 40 of the printed circuit board 10 remain accessible from the side opening 152 of the outer casing 150. The side opening 152 being closed by a lid 153 and fixed by means of fixing elements 154 (such as screws).

As highlighted previously, the present invention brings various advantages over the state of the art, shorter time and fewer number of steps for assembly on the production lines, economy by eliminating cables, practicality in assembly, disassembly, maintenance, replacement of components, low production cost, among others.

Having described an example of a preferred embodiment, it should be understood that the scope of the present invention encompasses other possible variations, being limited solely by the content of the accompanying claims, potential equivalents included therein.

The invention claimed is:

1. An electronic control connector (30) to connect a pin of a connector of a hermetic compressor (210) to a track of a printed circuit board (10), the electronic control connector (30) comprising:

an input orifice (32*a*);

a fixing leg (33); and an electrically conductive terminal (34) being inserted inside the input orifice (32*a*) so as to establish an electrical connection between the terminal (34) of the electronic control connector (30) and the tracks of the printed circuit board (10) of an electronic control (50) of the hermetic compressor (210), by means of an electronic contact portion (34*d*) of the terminal (34), the electronic control connector (30) being fixed to the printed circuit board (10) of the electronic control (50) by means of a fixing between the fixing leg (33) and a fixing orifice (16) disposed on the printed circuit board (10) of the electronic control (50), the terminal (34) comprising a side support projection (34*c*) disposed adjacent to an inner surface of a cavity formed between first and second support walls (32*b*, 32*c*) and the input orifice (32*a*) of the electronic control connector (30), an end of the side support projection (34*c*) being disposed adjacent to the printed circuit board (10), the side support projection (34*c*) being supported on the printed circuit board (10) so as to prevent deformation of the terminal (34) when being electrically connected to the pin of the connector of the hermetic compressor (210), the electronic control connector (30) being configured to enable an angular movement of the electric contact portion (34*d*) while the electronic control connector (30) is being fixed to the printed circuit board (10).

2. The electronic control connector (30) according to claim 1, wherein the electronic control connector (30) is fixed on the printed circuit board (10) by means of snap-fit fixation between the fixing leg (33) and the fixing orifice (16).

3. The electronic control connector (30) according to claim 1, wherein the electronic control connector (30) is fixed on the printed circuit board (10) by soldering the fixing leg (33) to the fixing orifice (16).

4. The electronic control connector (30) according to claim 1, wherein the fixing leg (33) comprises a projection positioned on an outer circumference of an upper surface of the electronic control connector (30), the fixing leg (33) comprising an outward-sticking tooth in the opposite direction to a vertical axis of an upper surface of the electronic control connector (30).

5. The electronic control connector (30) according to claim 4, wherein the fixing leg (33) is L-shaped.

6. The electronic control connector (30) according to claim 5, wherein the fixing leg (33) elastically deforms towards the input orifice (32*a*) by applying pressure, enabling the fixing of the electronic control connector (30) to the fixing orifice (16) of the printed circuit board (10).

7. The electronic control connector (30) according to claim 6, wherein the fixing leg (33) elastically returns toward its initial position by interrupting the application of pressure, enabling the electronic control connector (30) to be locked in the fixing orifice (16) of the printed circuit board (10).

8. The electronic control connector (30) according to claim 1, wherein the electric contact portion (34*d*) comprises a curvilinear shape.

9. The electronic control connector (30) according to claim 1, wherein the electric contact portion (34*d*) is V-shaped.

10. The electronic control connector (30) according to claim 1, wherein the first support wall (32*b*) and the second support wall (32*c*) are both located adjacent the input orifice (32*a*).

11. The electronic control connector (30) according to claim 10, wherein the first and the second support walls (32*b*, 32*c*) are opposite to each other in relation to the input orifice (32*a*).

12. The electronic control connector (30) according to claim 11, wherein the first and the second support walls (32*b*, 32*c*) and the input orifice (32*a*) form the cavity.

13. The electronic control connector (30) according to claim 12, wherein the first support wall (32*b*) comprises a recess (32*d*).

14. The electronic control connector (30) according to claim 13, wherein the fixing leg (33) is disposed perpendicularly to the first support wall (32*b*) and to the second support wall (32*c*).

15. The electronic control connector (30) according to claim 14, wherein the terminal (34) comprises an upper portion (34*a*) including a central orifice comprising a shape cooperative with the shape of the input orifice (32*a*) of the electronic control connector (30).

16. The electronic control connector (30) according to claim 15, wherein the central orifice extends from the upper portion (34*a*) to a lower portion (34*b*) of the terminal (34).

17. The electronic control connector (30) according to claim 16, wherein the side support projection (34*c*) extends linearly from the upper portion (34*a*) to beyond the lower portion (34*b*) along one of the sides of the terminal (34).

18. The electronic control connector (30) according to claim 16, wherein the electric contact portion (34*d*) projects outwardly from the end and in an opposite direction to a vertical axis of the lower portion (34*b*).

19. The electronic control connector (30) according to claim 18, wherein the side support projection (34*c*) is disposed adjacent to the fixing leg (33).

20. The electronic control connector (30) according to claim 18, wherein the electric contact portion (34*d*) has a degree of freedom of movement capable of enabling the angular movement of the electric contact portion (34*d*).

21. The electronic control connector (30) according to claim 16, wherein the electric contact portion (34*d*) comprises:

a first straight portion (35) which projects from an end of the lower portion (34*b*), a curvilinear portion (36) which begins from an end of the first straight portion (35), and a second straight portion (37) which begins from an end of the curvilinear portion (36).

22. The electronic control connector (30) according to claim 16, wherein the terminal (34) further comprises a fixing projection (34*e*) disposed between the upper portion (34*a*) and the lower portion (34*b*) of the terminal (34), and wherein the fixing projection (34*e*) projects outwardly from a point near the upper portion (34*a*) to a point near the lower portion (34*b*).

23. The electronic control connector (30) according to claim 22, wherein the fixing projection (34*e*) projects inwardly of the recess (32*d*) of the electronic control connector (30).

24. The electronic control connector (30) according to claim 23, wherein the fixing projection (34*e*) is configured to lock the terminal (34) to the electronic control connector (30).

25. The electronic control connector (30) according to claim 16, wherein the upper portion (34*a*) and the lower portion (34*b*) of the terminal (34) are inserted into the cavity formed between the first and the second support walls (32*b*, 32*c*) and the input orifice (32*a*) of the electronic control connector (30).

26. An electronic control (50) for driving a variable capacity hermetic compressor (200) comprising a printed circuit board (10) and an electronic control connector (30), the printed circuit board (10) comprising tracks and a fixing orifice (16), the electronic control connector (30) comprising an input orifice (32*a*), a fixing leg (33) and an electrically conductive terminal (34), the terminal (34) being inserted inside the input orifice (32*a*) so as to establish an electrical connection between the terminal (34) of the electronic control connector (30) and the tracks of the printed circuit board (10) of the electronic control (50) of the hermetic compressor (210), by means of an electric contact portion (34*d*) of the terminal (34), the terminal (34) comprising a side support projection (34*c*) disposed adjacent to an inner surface of a cavity formed between first and second support walls (32*b*, 32*c*) and the input orifice (32*a*) of the electronic control connector (30), an end of the side support projection (34*c*) being disposed adjacent to the printed circuit board (10), the side support projection (34*c*) being supported on the printed circuit board (10) so as to prevent deformation of the terminal (34) when being electrically connected to a pin of a connector of the hermetic compressor (210), the electronic control connector (30) being configured to enable an angular movement of the electric contact portion (34*d*) while the electronic control connector (30) is being fixed to the printed circuit board (10).

* * * * *